US006517917B2

(12) United States Patent
Brüning et al.

(10) Patent No.: US 6,517,917 B2
(45) Date of Patent: Feb. 11, 2003

(54) SHAPED BODIES FOR TRANSPORTING, PACKAGING, STORING, AND HANDLING FOOD PRODUCTS

(75) Inventors: Hans-Joachim Brüning, Augsburg (DE); Peter Striegl, Bobingen (DE); Andreas Lichtblau, Mittelstetten (DE)

(73) Assignee: Teijin Monofilament Germany GmbH, Bobingen (DE)

( * ) Notice: Subject to any disclaimer, the term of this patent is extended or adjusted under 35 U.S.C. 154(b) by 0 days.

(21) Appl. No.: 09/790,536

(22) Filed: Feb. 23, 2001

(65) Prior Publication Data

US 2001/0018103 A1 Aug. 30, 2001

(30) Foreign Application Priority Data

Feb. 25, 2000 (DE) ..... 100 08 845

(51) Int. Cl.[7] ..... B29D 22/00; B29D 23/00

(52) U.S. Cl. ..... 428/35.2; 428/36.1; 428/364; 264/210.8; 264/211.17; 524/292; 524/293; 524/284

(58) Field of Search ..... 428/36.1, 35.2, 428/364; 264/210.8, 211.17; 524/292, 293, 284

(56) References Cited

U.S. PATENT DOCUMENTS 4,783,496 A * 11/1988 Simon et al. ..... 524/292

FOREIGN PATENT DOCUMENTS

| | | | | |
|---|---|---|---|---|
| DE | 000342563 | * | 11/1989 | ..... D01F/6/92 |
| EP | 0 342 563 | A2 | 5/1989 | |
| EP | 0 976 854 | A1 | 2/2000 | |
| JP | 56-118912 | A | 9/1981 | |
| JP | 57-161137 | A | 10/1982 | |

* cited by examiner

*Primary Examiner*—Mark L. Bell
*Assistant Examiner*—Shalie A. Manlove
(74) *Attorney, Agent, or Firm*—Burns, Doane, Swecker & Mathis, LLP

(57) ABSTRACT

The invention describes food-compatible monofilaments and flat-shaped bodies made from them, wherein the monofilaments are based on polyester with the addition of 0.5 to 3.5 percent by weight of a polycarbonate, and which are characterized by an especially high abrasion resistance and resistance to foods. The shaped bodies are used for transporting, packaging, storing and handling foods and are characterized by reduced abrasion and an increased abrasion resistance. The quality of the foods that come into contact with such shaped bodies is excellent.

16 Claims, No Drawings

SHAPED BODIES FOR TRANSPORTING, PACKAGING, STORING, AND HANDLING FOOD PRODUCTS

The invention relates to shaped bodies and methods for their production, the shaped bodies being used for transporting, packaging, storing, and handling food products, the shaped bodies made of monofilaments based on polyesters, and the monofilaments required for this, as well as methods for their production.

Monofilaments based on polyesters have been known for some time and are used in very different fields of technology, for example, in the form of industrial textile materials, such as woven materials used in the pressing section of paper machines.

Such monofilaments are described, for example, in EP 0 342 563 A2.

In these fields of application, hydrolysis resistance and mechanical properties such as bending strength and splitting resistance are particularly important.

When used in the food industry, i.e., for objects that come into contact with food products, for example during transport, packaging, and storage or also during the handling of food products, such as in sieves or on drying belts, it is very important that the abrasion is very low, because even the most minuscule particles enter the food and may then result in a health hazard when these food products that carry the abraded particles are consumed.

It is also important that the materials that come into contact with food do not contain any substances that diffuse out of the object or can be dissolved from them and then enter the food. It is also important that these materials are not only hydrolysis-resistant but also are substantially resistant to chemical substances that may be released from food products themselves when these are contacted. This in particular includes, among others, organic acids, but also fats, esters, and similar substances.

Even though numerous materials are known that come into direct contact with food products during the transport, packaging, storage, and also handling of food products, there is still a need for analogous materials that are improved and can be easily produced.

It is therefore the objective of the invention to provide food-compatible materials which can be in direct contact with foods during transport, packaging, storage, and also handling, which are characterized by improved abrasion characteristics, in particular also by improved abrasion resistance, and which during the contact do not give off any abraded particles and harmful substances into the food, which are easily, economically and safely produced, and which meet today's requirements and demands for materials that come into contact with foods.

This objective is realized by food-compatible, flat-shaped bodies or shaped bodies made from flat shaped bodies, such as woven and non-woven materials, knits, multiaxial layers, flat structures, such as grids, net-shaped flat structures, etc., or shaped bodies made from these flat shaped bodies, such as sacks, bags, nets, sieves, filters, transport belts, etc., containing monofilaments based on polyester that contain 0.5 to 3.5% by weight of a polycarbonate. The shaped bodies according to the invention preferably contain monofilaments having a knife abrasion resistance of 55,000 to 170,000 abrasion cycles. It is preferred that the polyester that makes up the monofilaments is free from terminating agents, such as mono- or polycarbodiimide.

Especially advantageous embodiments of the food-compatible, flat-shaped bodies according to the invention are described in claims 3 to 10.

Another embodiment of the invention relates to food-compatible monofilaments based on polyester that contain 0.5 to 3.5% by weight of a polycarbonate. These food-compatible monofilaments preferably have a knife abrasion resistance of 55,000 to 170,000 abrasion cycles.

Another embodiment of the invention is a procedure for producing flat-shaped bodies or shaped bodies made from flat-shaped bodies, such as woven and non-woven materials, knits, multiaxial layers, spiral cloths or spiral sieves, pin wires, flat structures such as grids or net-shaped flat structures etc., or shaped bodies made from these flat shaped bodies, such as nets, sacks, bags, nets, sieves, filters etc. for transport, packaging, storage, and handling of foods by spinning polyester with an additive of 0.5 to 3.5% by weight of a polycarbonate in the molten mass by extrusion into monofilaments, and the monofilaments are processed into flat shaped bodies, such as woven materials, looped materials, nets, etc., and the flat shaped bodies are, if required, made into sacks, bags, filters, transport belts, etc.

It is preferred that polyethylene terephthalate is used as the polyester. The intrinsic viscosity, measured in dichloroacetic acid at 25° C., is preferably between 0.5 to 1.5 dl/g, in particular 0.68 to 0.915 dl/g. But other polyesters, such as polybutylene terephthalate can also be used. Very useful are also copolyesters, in which the acid component, for example the terephthalic acid, is partially substituted with another acid component, in particular isophthalic acid. Modifications by partial substitution of the glycol components, for example the ethylene glycol, with 1,4-dihydroxymethylcyclohexane are also possible.

For the polycarbonate, commercially available products, for example the one marketed by Bayer AG under the trademark MAKROLON, can be used.

In a particularly advantageous embodiment of the method according to the invention, the polyesters do not contain any terminating agents, such as mono- or polycarbodiimide.

The flat-shaped bodies produced from monofilaments based on polyesters with an additive of 0.5 to 3.5% by weight of a polycarbonate, such as woven and non-woven materials, knits and other looped materials, spiral cloths or spiral sieves, pin wires, nets and grid-shaped fat structures can be used to produce ready-made articles, such as bags, sacks, sieves, filters, transport belts, etc.

The food-compatible monofilaments according to the invention can be used to produce the flat-shaped bodies or the shaped bodies composed of the flat-shaped bodies. These food-compatible monofilaments are based on polyesters that contain 0.5 to 3.5% by weight of a polycarbonate; they preferably have a knife abrasion resistance of 55,000 to 170,000 abrasion cycles with the knife abrasion resistance is determined according to the procedure described hereafter. The polycarbonate is preferably distributed homogeneously in the polyester.

The monofilaments preferably are produced according to a method in which a mixture of a polyester and 0.5 to 3.5% by weight of a polycarbonate is spun from a molten mass, the resulting monofilaments are cooled in a spinning bath, are stretched, and, if necessary, are wound.

The extrusion speed of the molten mass, the drawing during spinning and the stretching are hereby adapted to each other so that the monofilaments have a diameter of at least 0.07, preferably 0.1 to 1.5 mm.

To produce the shaped bodies according to the invention, monofilaments are produced by extrusion through nozzles of polyester, especially of polyethylene terephthalate to which have been added 0.5 to 3.5% polycarbonate by weight.

Preferably, polyethylene terephthalate is used as the polyester. Also advantageous are polybutylene terephthalate or copolyesters, such as, in particular, polyethylene terephthalate in which the terephthalic acid component has been partially substituted with isophthalic acid.

The raw materials, i.e. the polyester and the polycarbonate, are mixed well with each other and then melted in an extruder, filtered in a spinning pack, and spun through a spinning nozzle.

On leaving the spinning nozzle, the exiting molten mass monofilaments are quenched with cooling in a spinning bath that preferably is a water bath. The spinning bath generally has a temperature of 30 to 90° C., in particular 70° C. The threads are then wound or pulled off at a speed that is greater than the extrusion speed of the molten mass. The drawing during spinning generally is 1:1.5 to 1:6.0, preferably 1:3 to 1:5, and the spinning pull-off or draw speed is 5 to about 40 m per minute.

The spun monofilament produced in this manner is again stretched, preferably in several stages, in particular in 1, 2 or 3 stages, i.e. with a total ratio of 1:4 to 1:8.

The stretching is able to influence the mechanical properties, such as initial modulus, maximum tensile strength, pull-back force extension, but also looping resistance and knotting resistance as well as shrinkage. Naturally, the titer of the resulting monofilament also depends on the stretching. Output volume and stretching are adjusted to each other in such a way that the resulting monofilaments in the end have a diameter of at least 0.07 mm. Within the context of this invention, diameters of, for example, 0.07 to 1.5 mm were found to be especially useful.

The monofilaments produced in this manner are then further processed into flat shaped bodies, i.e. into woven materials, flat looped materials, such as non-wovens, knits, spiral cloths or spiral sieves, pin wires, into flat-shaped structures with a net structure, for example grids in which monofilaments are positioned parallel in one direction, and on top of which groups of monofilaments are positioned that run counter to the first layer of the monofilaments, i.e. at an angle of approximately 10° to 90°, whereby the monofilaments can be fixed at the cross-over points, for example by melt fusion.

The corresponding flat structures then can be used as such or can be further made into sacks, bags, nets, transport belts, filters, etc.

These materials can then be used for the transport, packaging, storage, and handling of foods.

In processing procedures during which the food products must be moved via transport belts, corresponding flat structures according to the invention can be used with particular advantage.

Sieves are also very advantageous, such as when used, for example, when washing foods.

Especially advantageous are transport belts produced form the previously described monofilaments and used for drying foods, especially for foods like died fruit, noodles, etc. The foods are moved by way of these transport belts through drying zones.

The knife abrasion test for determining the knife abrasion resistance is performed as described hereafter. For this purpose, the G550 device distributed by Zweigle Company, Reutlingen, Germany, is used. Ten 20 cm long samples of the monofilament to be tested are tightly clamped in at one end and are guided via a deflector and are provided at their other end with the pre-load. Below the samples, a ceramic tube with a diameter of 1 mm, embedded in a metal rail, moves cyclically back and forth. The ceramic tube is manufactured by Degussit Company and can be purchased from Friatec AG, Mannheim, Germany. The lifting distance is 70 mm. The constant abrasive stress from the extremely hard ceramic surface damages the monofilaments until they tear under the effect of the pre-load. An automatic counter records the number of abrasion cycles to breakage for each individual monofilament. The obtained cycle numbers for 10 samples are used to calculate statistical values (median value) that presents a value for the abrasion resistance of the tested monofilament. The pre-loading force is set to 0.135 cN/tex, rounded to a full 10 cN.

It was especially surprising that foods that come into contact with the shaped bodies according to the invention, regardless of whether this occurs during transport, packaging, storage or handling of the foods, do not take in any abrasion-induced particles or any other substances from the material from which the flat structures are produced.

This improves the keeping qualities of the foods and prevents the foods from acquiring substances that are health hazards.

The hydrolysis resistance of the shaped bodies according to the invention is also excellent. The long-term stressability of conveyor belts on which moist or wet foods are transported is also improved.

It was especially surprising that the monofilaments according to the invention can also be processed into flat structures, such as transport belts on which foods are dried. For example, especially when manufacturing dried fruit, the fresh fruit, which is still partially moist, is passed on a corresponding transport belt through drying zones. The moisture removed from the fruit is not only in the form of water that, in the form of steam, could cause hydrolysis of the transport belt material, but organic substances, such as organic acids, esters, aromatic substances, and others also escape. These substances also could attack the transport belt material, whether they are in the form of vapors or liquids, and in this way could reduce the useful life of the transport belts. These substances also could bring about a breakdown of the polycondensates from which the monofilaments are produced. It is surprising that with the invention these phenomena do not occur or occur only to a significantly reduced degree.

It was particularly surprising that the abrasion as determined with the knife abrasion test is significantly lower than for monofilaments that consist solely of polyethylene terephthalate.

The invention is described in more detail with the following examples:

COMPARATIVE EXAMPLE 1

In a known manner, a monofilament having a diameter of 0.50 mm was produced from polyethylene terephthalate having an intrinsic viscosity (IV) of 0.69 dl/g. A set of samples of 10 monofilaments was tested in the knife abrasion device G550 of Zweigle Company. The median of the abrasion cycles to breakage was 42,214 cycles.

COMPARATIVE EXAMPLE 2

In a known manner, a monofilament having a diameter of 0.50 mm was produced from polyethylene terephthalate having an intrinsic viscosity (IV) of 0.88 dl/g. A set of samples of 10 monofilaments was tested in the knife abrasion device G550 of Zweigle Company. The median of the abrasion cycles to breakage was 93,458 cycles.

EXAMPLE 1

In an otherwise known manner, a monofilament was produced from polyethylene terephthalate having an intrinsic viscosity (IV) of 0.88 dl/g, 0.93% by weight of polycarbonate (MAKROLON brand by Bayer) was added to the polyethylene terephthalate, and this mixture was processed in an otherwise known manner into a monofilament having a diameter of 0.50 mm. Ten monofilaments were tested in the knife abrasion device G550 of the Zweigle Company. The median of the abrasion cycles to breakage was 116,409 cycles. This value is 25 percent higher than the value from Comparative Example 2.

EXAMPLE 2

In an otherwise known manner, a monofilament was produced from polyethylene terephthalate having an intrinsic viscosity (IV) of 0.88 dl/g, wherein an amount of 1.40 percent by weight of polycarbonate granules (MAKROLON brand by Bayer) was added to the polyethylene terephthalate, and this mixture was processed in an otherwise known manner into a monofilament having diameter of 0.50 mm. Ten monofilaments were tested in the knife abrasion device G550 of the Zweigle Company. The median of the abrasion cycles to breakage was 155,729 cycles, i.e. nearly 70 percent higher than the value from Comparative Example 2.

EXAMPLE 3

In an otherwise known manner, a monofilament was produced from polyethylene terephthalate granulate having an intrinsic viscosity (IV) of 0.88 dl/g, wherein an amount of 1.90 percent by weight of polycarbonate (MAKROLON brand by Bayer) was added to the polyethylene terephthalate, and this mixture was processed in an otherwise known manner into a monofilament having a diameter of 0.50 mm. Ten monofilaments were tested in the knife abrasion device G550 of the Zweigle Company. The median of the abrasion cycles to breakage was 131,921 cycles. This also presents a significant increase in the knife abrasion resistance from Comparative Example 2.

The examples show that the monofilaments without polycarbonate addition, i.e. consisting solely of polyethylene terephthalate, have a significantly higher abrasion, measured as cycles to breakage, than the monofilaments that according to the present invention contain polycarbonate.

EXAMPLE 4

Analogously to Comparative Example 1, but with the addition of 2.3 percent by weight of polycarbonate (MAKROLON brand by Bayer), monofilaments are obtained having a median of abrasion cycles to breakage of 95,737 cycles, i.e. more than twice the number than in Comparative Example 1.

We claim:

1. Food-compatible shaped bodies prepared from monofilaments comprising a polyester containing 0.5 to 3.5 percent by weight of polycarbonate.

2. A shaped body as claimed in claim 1, characterized in that the monofilaments have a knife abrasion resistance of 55,000 to 170,000 abrasion cycles.

3. A shaped body as claimed in claim 1, wherein the polyester is free of terminating agents.

4. A shaped body as claimed in claim 1, characterized in that the shaped body is a woven material.

5. A shaped body as claimed in claim 1, characterized in that the shaped body is a looped material.

6. A shaped body as claimed in claim 1, characterized in that the shaped body is a net.

7. A shaped body as claimed in claim 1, characterized in that the shaped body is a bag.

8. A shaped body as claimed in claim 4, characterized in that the shaped body is a sieve.

9. A shaped body as claimed in claim 1, characterized in that the shaped body is a filter.

10. A shaped body as claimed in claim 1, characterized in that the shaped body is a transport belt.

11. A food-compatible monofilament comprising a polyester containing 0.5 to 3.5 percent by weight of a polycarbonate.

12. A food-compatible monofilament as claimed in claim 11, characterized in that the monofilament has a knife abrasion resistance of 55,000 to 170,000 abrasion cycles.

13. A shaped body as claimed in claim 2, wherein the polyester is free of terminating agents.

14. A shaped body as claimed in claim 2, characterized in that the shaped body is a woven material.

15. A shaped body as claimed in claim 2, characterized in that the shaped body is a looped material.

16. A shaped body as claimed in claim 2, characterized in that the shaped body is a net.

* * * * *